United States Patent [19]

Rosenberger

[11] 3,947,192

[45] Mar. 30, 1976

[54] PAVING BLOCK

[76] Inventor: Hugo Rosenberger, Alzenauer Strasse 29a-33, 8756 Kahl (Main), Germany

[22] Filed: Nov. 15, 1974

[21] Appl. No.: 524,055

[52] U.S. Cl. ..... 404/41; 52/604

[51] Int. Cl.[2] ..... E01C 5/00

[58] Field of Search ..... 404/41, 42; 52/596, 604

[56] References Cited

UNITED STATES PATENTS

| | | | |
|---|---|---|---|
| 1,437,304 | 11/1922 | Healy | 404/41 X |
| 2,493,458 | 1/1950 | Koenig | 404/41 X |
| 2,605,681 | 8/1952 | Trief | 404/41 |
| 3,494,266 | 2/1970 | Baumberger | 404/41 |
| 3,602,111 | 8/1971 | Clemente | 404/41 |

*Primary Examiner*—Nile C. Byers

*Attorney, Agent, or Firm*—Fulwider, Patton, Rieber, Lee & Utecht

[57] ABSTRACT

A paving block having sides which are shaped to provide an interlocking tooth engagement between the complementary sides of adjacent blocks when laid. Such engagement counteracts shifting of the laid blocks when loads are applied thereto.

11 Claims, 6 Drawing Figures

PAVING BLOCK

BACKGROUND OF THE INVENTION

1. Field of the Invention

The present invention relates to the art of paving.

2. Description of Prior Art

Masonry stones or blocks have been laid in adjacent relationship to define roadways, yards and the like for many years. Generally, the adjoining sides of such stones or blocks merely abut one another and are not provided with any special interlocking means. As a result, such stones or blocks are subject to relative displacement when loads are applied thereto.

SUMMARY OF THE INVENTION

It is a major object of the present invention to provide a paving block having side edges formed with a concave portion adjoining a rectilinear portion which adjoins a convex portion. Such paving block is laid adjacent other blocks having complementary side edges, with the side edges of the contiguous blocks being interlocked. The resulting paving resists shifting of the blocks when loads are applied thereto.

Another object of the present invention is to provide a paving block arrangement of the aforedescribed nature having plan configurations of varying geometrical shapes.

A further object is to provide a paving block wherein the side portions are chamfered.

DETAILED DESCRIPTION OF THE DRAWINGS

Figure 1:
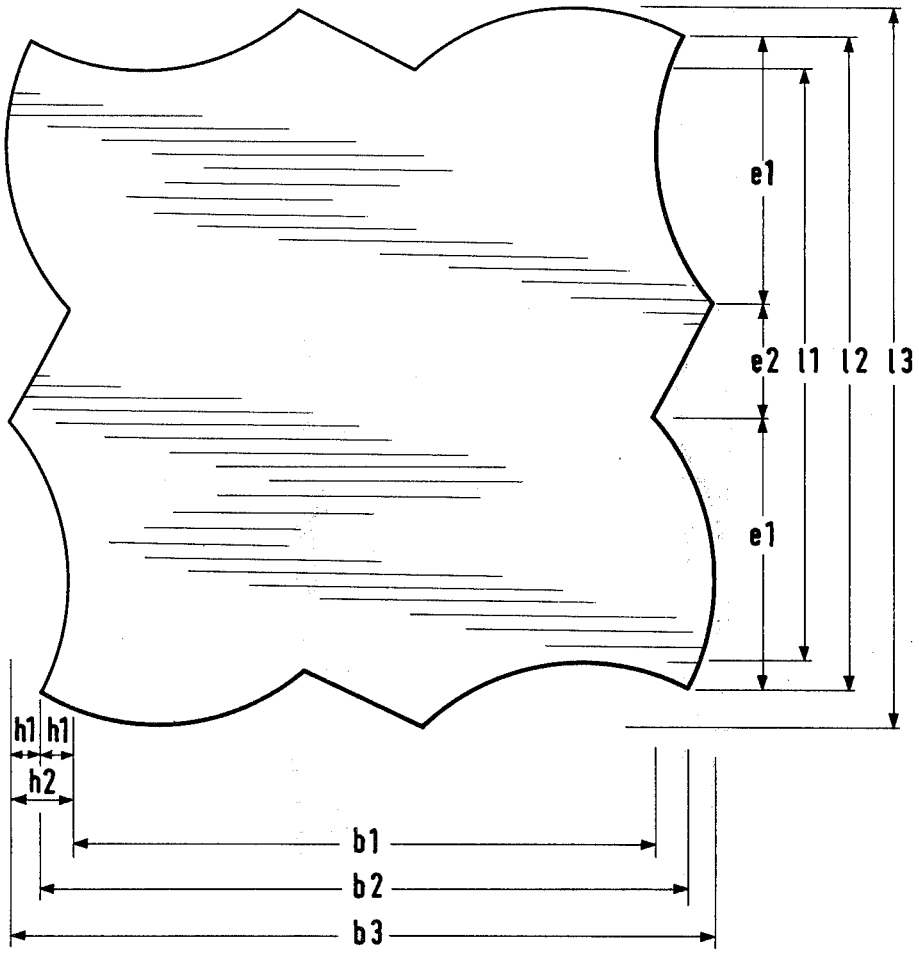
FIG. 1 is a plan view of a paving stone or block embodying the present invention with three basic shapes provided on each side of the stone or block.

Referring to the accompanying drawings, the embodiment of the present invention shown in FIG. 1 is seen to comprise a paving block having symmetrical defining surfaces on all four sides of such stone or block, each surface of each side consisting in each case of the three basic shapes, a concave portion an adjoining rectilinear portion and an adjoining convex portion. The rectilinear portion in each case is inclined at the angle of 45° to a tangent connecting the point of maximum depth of the concave portion or the point of maximum height of the concave portion.

More particularly, the length *e* 1 of the concave portion of the stone or block corresponds to the length *e* 1 of the convex portion and these lengths together with the length *e* 2 of the rectilinear portion taken in the same direction, correspond to the mean overall length *l* 2 and the mean overall breadth *b* 2 of the three basic shapes. The three basic shapes are related to the apex height *h* 2, the rectilinear portion corresponding to the full apex height *h* 2 and the arcs of concave portion and convex portion terminating in each case at half, namely *h*-1, of the full apex height *h* 2. This feature produces a symmetrical closed tooth engagement on all sides. The mean overall length *l* 2 of the three basic shapes lies in the order of magnitude between 90 and 130 mm, preferably at 110 mm. The length of the concave portion *e* 1 and that of the convex portion *e* 1 is in the ratio of about 1:2.5 to the mean overall length *l* 2 of the three basic shapes. In accordance with the above mentioned conditions, accordingly, the mean length $$l\,2 = \frac{l\,1 + l\,3}{2},$$

where *l* 1 is the inner and *l* 3 the outer overall length of the bonding stone and in correspondence *l* 1, *l* 2, *l* 3 = *b* 1, *b* 2, *b* 3.

Figure 2:
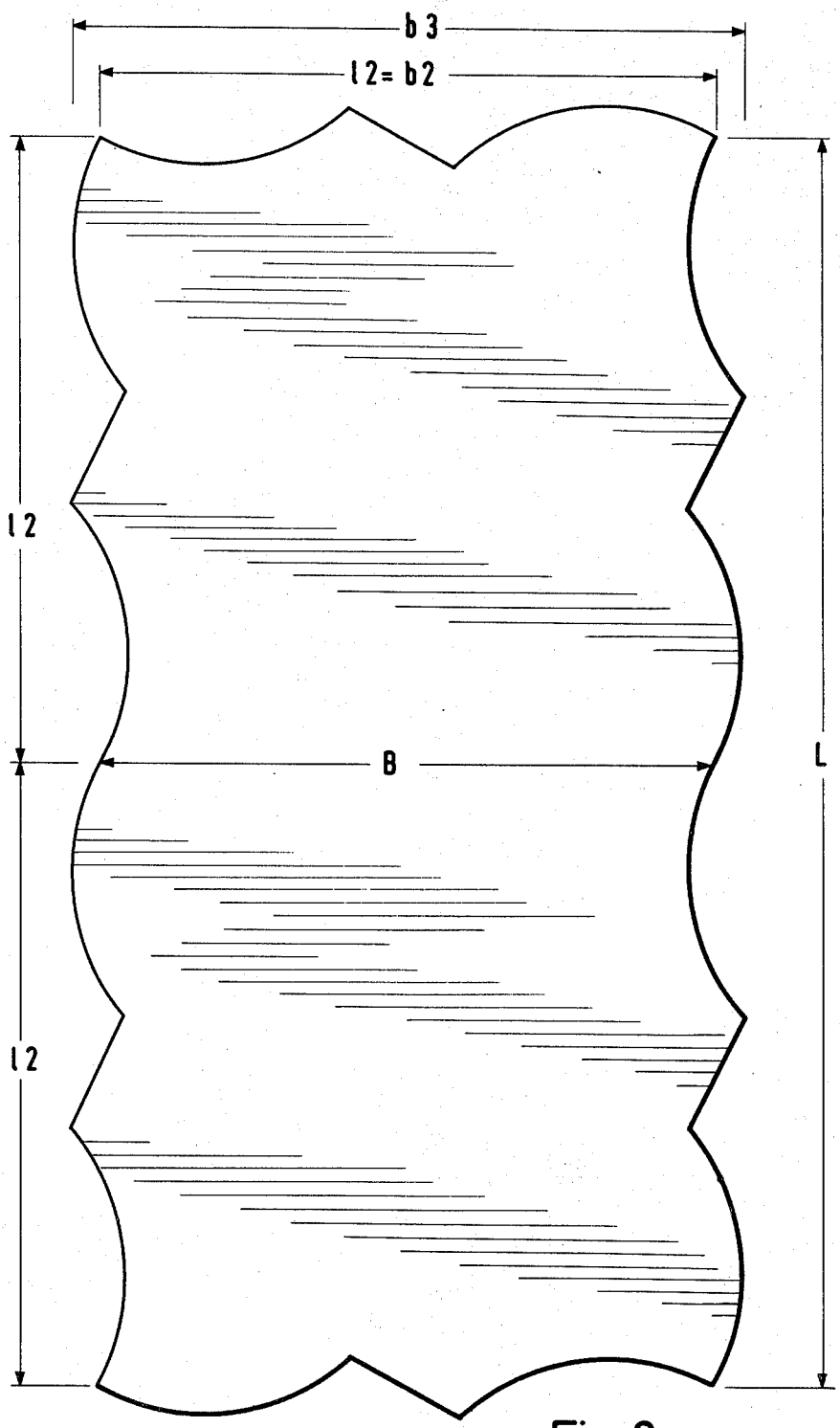
FIG. 2 is a rectangular paving stone or block embodying the present invention.

In the embodiment shown in FIG. 2, the three basic shapes form the two short sides of a rectangular paving stone or block, the long sides being formed by two of each of the three basic shapes set in one direction in succession. The mean breadth B of this rectangular paving stone or block coreesponds approximately to the mean overall length *l* 2 of the three basic shapes, by way of example, approximately a hand's breadth. The external breadth *b* 3 of this stone or block corresponds to the external breadth *b* 3 of the stone shown in FIG. 1. The mean length L of this stone or block corresponds to twice the mean overall length *l* 2 or the mean overall breadth *b* 2 of the three basic shapes.

Figure 3:
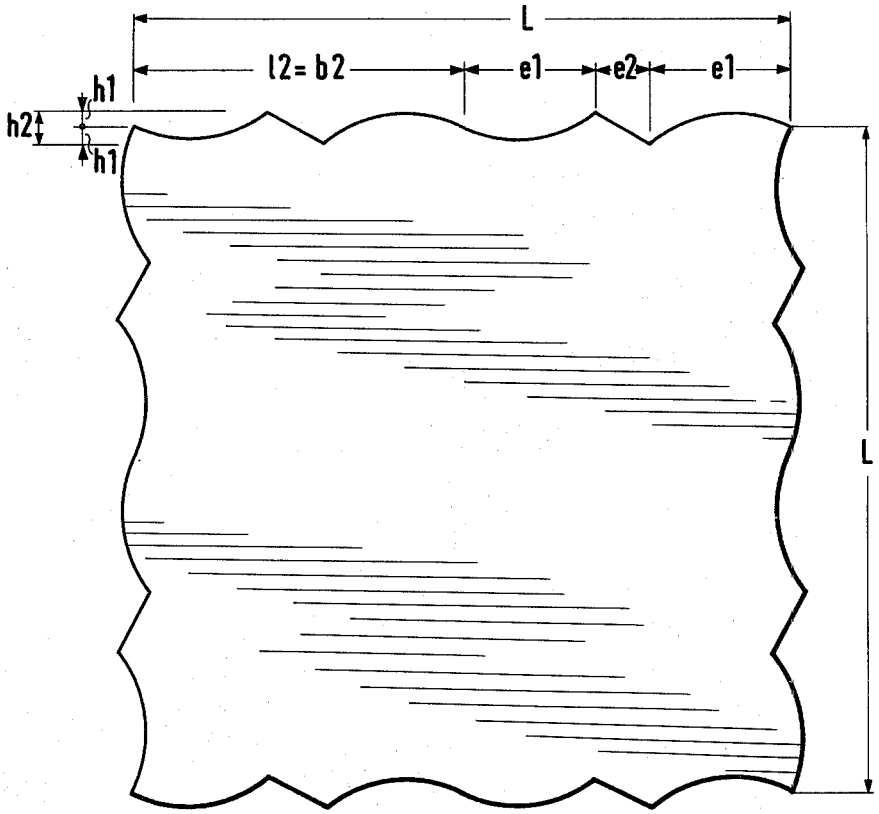
FIG. 3 is a square paving stone or block embodying the present invention, which stone or block is the equivalent of the two rectangular stones shown in FIG. 2.

The paving stone shown in FIG. 3, is the equivalent of two of the paving stones or blocks shown in FIG. 2 set side by side, the same geometric relationships being valid for this stone as for the paving stones as shown in FIGS. 1 and 2, so that the length L corresponds to the length L according to FIG. 2.

Figure 4:
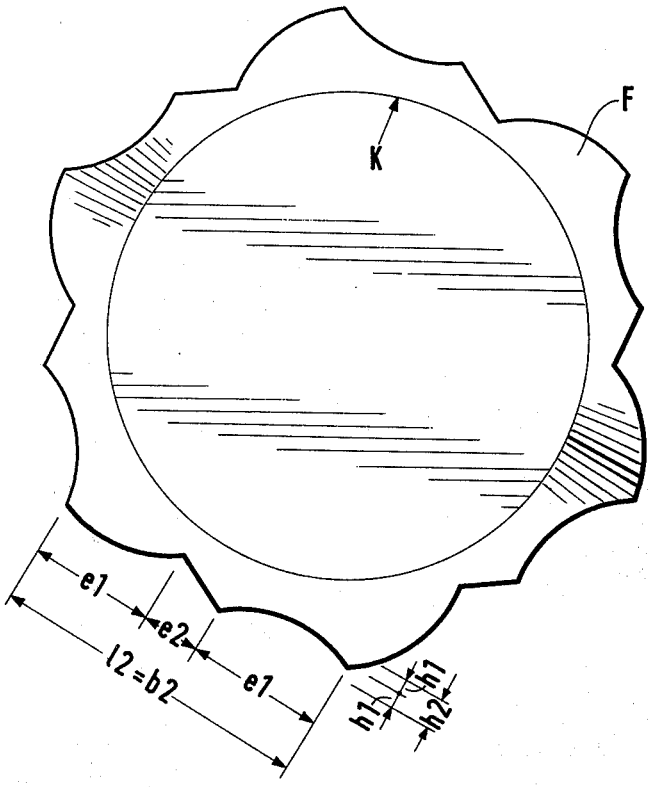
FIG. 4 is a hexagonal paving stone or block embodying the present invention in which each of the three basic shapes are repeated six times.

In FIG. 4 there is shown a paving stone which in plan view is substantially of hexagonal form, the three basic shapes concave, rectilinear and convex according to FIG. 1 being incorporated six times in the sides. Again the symmetrical dimensions on all of the six sides correspond to the basic dimensions according to FIG. 1. It should be particularly noted that this embodiment of the paving stone embodying the present invention can be provided with a chamfer F starting from a central circle K.

It should also be noted that FIGS. 1 and 2 are represented on the scale 1:1, FIGS. 3 and 4 are shown on the scale 1:2.

The tooth engagement of the paving stones or blocks embodying the present invention is designed so that thus an optimum is obtained, so that disadvantages of such stones hitherto, especially in relation to their shifting, are overcome. With the paving stones or blocks embodying the invention the slightest shift even in laying, irrespective of the direction, is no longer possible. The paving stones embodying the present invention guarantee security and substantially no lateral shift or distortion of any kind, under heaviest loading. The forces occurring in all directions are taken up uniformly.

A further advantage of the paving stones embodying the present invention consists in that in laying they need to be neither twisted or turned, but the direct toothings always fit in and against one another. If necessary, the edge or defining surfaces of a stone embodying the present invention, including the hexagonal paving stone, can be provided with a chamfer, whereby damage is avoided in loading and tipping on the building site and in shaking-in in laying, apart from the better adhesion quality of the laid stones. Especially, however, the chamfer F in the case of the hexagonal bonding stone achieves a considerably better adhesion of vehicles passing over paving made up of the stones, since the chamfer width is here varying, if in the design of the chamfer one starts from an inner circle K as shown in FIG. 4. Moreover, this feature achieves an attractive and ventilated optical effect which causes the stone to appear round, which is not otherwise possible with toothed paving stones.

Figure 5:
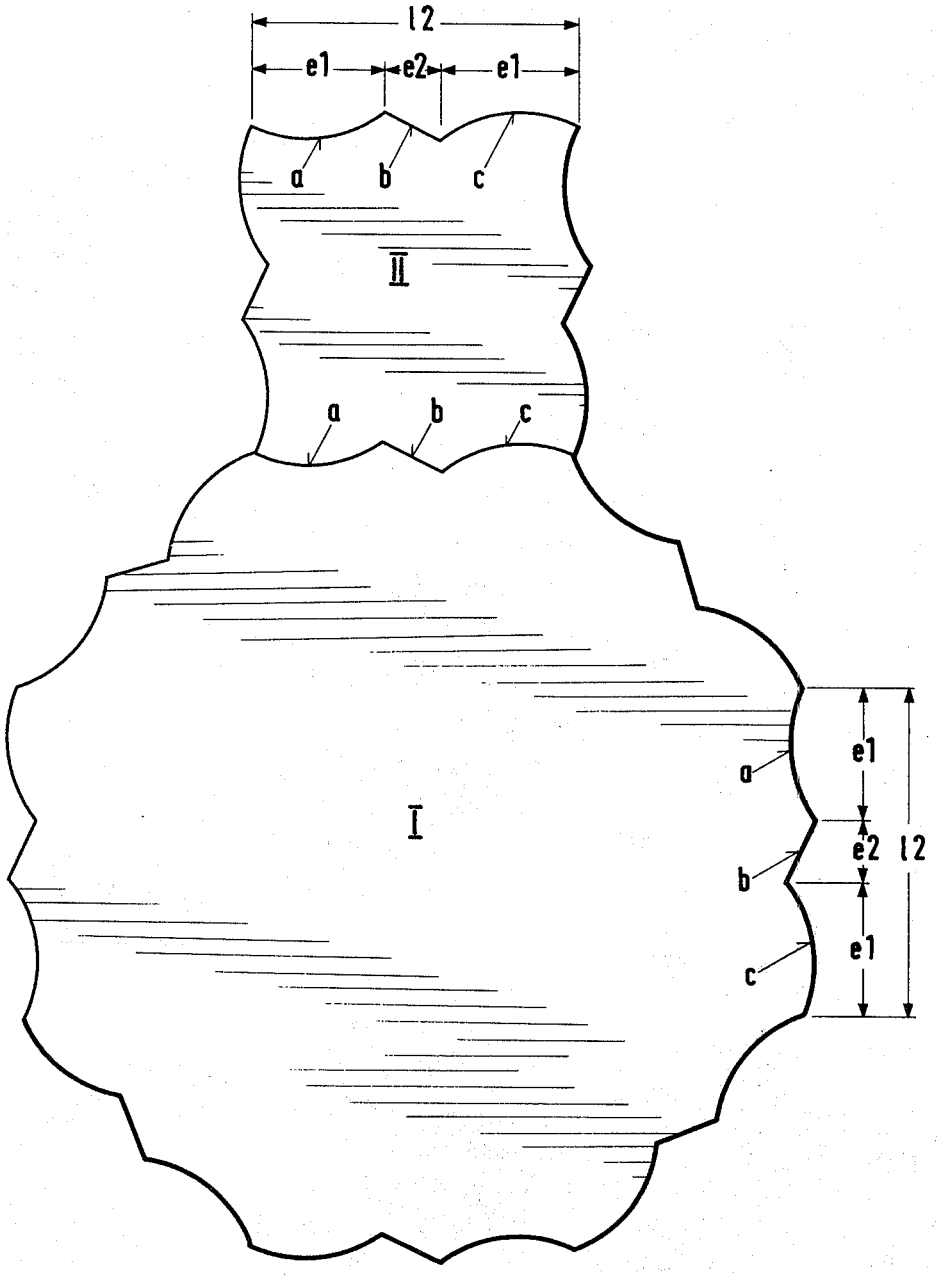
FIG. 5 is a plan view showing an octagonal paving stone or block with a smaller square stone or block in contact therewith.
Figure 6:
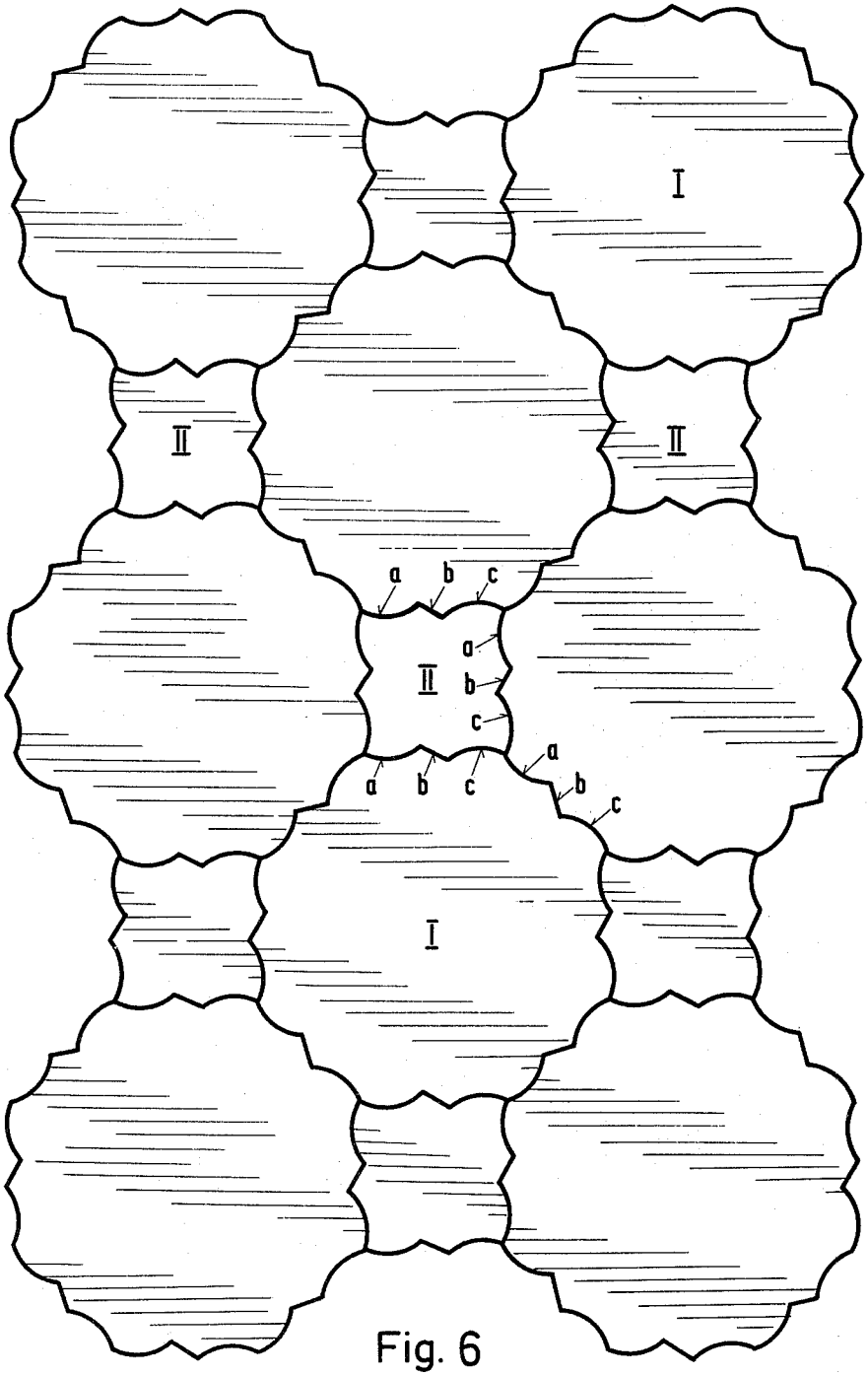
FIG. 6 is a plan view showing a plurality of octagonal and square stones or blocks.

FIGS. 5 and 6 show an embodiment of paving stone or block which is octagonal. The relationships of the dimensions of the concave, rectilinear and convex portions on the side edges are similar to that as described in relation to FIGS. 1 to 4.

As shown in FIG. 5, the side edges of the paving stones I and II have a concave portion *a*, an adjoining rectilinear portion b and an adjoining convex portion *c* and the mean length *l* 2 of each side is the sum of lengths *e* 1, *e* 2 and *e* 1.

As shown in FIG. 6, the stones I and II are laid in alternating sequence around a stone I. Against the octagonal paving stones I, which are thus relatively large, there are set firstly the relatively small square paving stones with the abutting portions *a*, *b* and *c* interengaging, then three portions *a*, *b*, *c* of a further adjoining octagonal paving stone are engaged with portions *a*, *b*, *c* of the octagonal stone and three portions engaged with the relatively small square stone II. The resultant paving accordingly has only two kinds of paving stones in very different size with otherwise fully symmetrical defining surfaces, which are repeated eight times in the case of the large paving stone and only four times in the case of the square paving stone, that is to say once on each side. The paving made up of such stones accordingly has a constant alternation in the stone size of two greatly differently dimensioned paving stones which, however, are joined symmetrically and closely to one another. As a result of the alternating availability, the grip firmness of the bond according to the invention is optimally increased. Furthermore, damage and waste of the two kinds of laid stones are largely avoided in transport, in shaking-in and in laying.

Various modifications and changes may be made with respect to the foregoing detailed description without departing from the spirit of the present invention.

I claim:

1. A paving block particularly for the laying of roadways, yards and the like, said block having symmetrical defining surfaces on all sides, said surfaces extending in the same direction on each side, and being disposed clockwise in a respective succession of a concave portion adjoining a rectilinear portion which in turn adjoins a convex portion with said rectilinear portion adjoining said concave portion and said convex portion at an angle of approximately 45°, and with the opposite ends of said concave portion and said convex portion being broken off at approximately one-half the apex height of said rectilinear portion.

2. A paving block as set forth in claim 1 wherein the length of the side edge over which the concave portion extends corresponds to the length of the side edge over which the convex portion extends, and these two lengths together with the length of the side edge over which the rectilinear portion extends corresponds to the mean overall length of the side edge.

3. A paving block as set forth in claim 1 wherein the ends of the concave and convex portions remote from the rectilinear portion terminate on a line which lies mid-way between the distance between the point where the rectilinear portion intersects the concave portion and the point where the rectilinear portion intersects the convex portion.

4. A paving block as set forth in claim 1 wherein the mean overall length of the side edge over which the three portions extend is 90 to 130 mm. and the length of the side over which the concave portion or convex portion extends is in the ratio of approximately 1:2.5 to the said mean overall length.

5. A paving block as set forth in claim 1 wherein the upper portion of said side edges are provided with a chamfer.

6. A paving block as set forth in claim 1 wherein said block is substantially square in plan view, each side being provided with said three portions.

7. A paving block as set forth in claim 1 wherein the paving block is oblong in plan view, the two shorter sides each being provided with said three portions, and with the two longer sides each having two series of said three portions.

8. A paving block as set forth in claim 1 wherein the paving block is rectangular in plan view, each side being provided with two series of said three portions.

9. A paving block as set forth in claim 1 wherein the block is hexagonal in plan view, with each of the six sides being provided with said three portions.

10. A paving block as set forth in claim 1 wherein the block is octagonal in plan view, with each of the eight sides being provided with said three portions.

11. A paving block as set forth in claim 5 wherein the chamfer extends from a central circle.

* * * * *